US010391357B2

(12) United States Patent
Wang

(10) Patent No.: US 10,391,357 B2
(45) Date of Patent: Aug. 27, 2019

(54) HEIGHT ADJUSTABLE AEROBIC STEP

(71) Applicant: Jen-Hung Wang, Taipei (TW)

(72) Inventor: Jen-Hung Wang, Taipei (TW)

( * ) Notice: Subject to any disclaimer, the term of this patent is extended or adjusted under 35 U.S.C. 154(b) by 34 days.

(21) Appl. No.: 15/491,398

(22) Filed: Apr. 19, 2017

(65) Prior Publication Data

US 2018/0207476 A1 Jul. 26, 2018

(30) Foreign Application Priority Data

Jan. 25, 2017 (CN) ..... 2017 1 0056335

(51) Int. Cl.
*A63B 23/04* (2006.01)
*A63B 21/00* (2006.01)

(52) U.S. Cl.
CPC .... *A63B 23/0458* (2013.01); *A63B 21/00047* (2013.01); *A63B 2210/50* (2013.01); *A63B 2225/093* (2013.01)

(58) Field of Classification Search
CPC ..... A63B 2225/093; A63B 23/0458; A63B 2210/50; A63B 17/04; A63B 21/00047; Y10T 403/32361; Y10T 403/32327
See application file for complete search history.

(56) References Cited

U.S. PATENT DOCUMENTS 5,108,089 A * 4/1992 Wilkinson ..... A63B 23/0458 108/12
5,645,511 A * 7/1997 Le Roux ..... A63B 23/0458 482/142
5,842,955 A * 12/1998 Wilkinson ..... A63B 23/0458 482/52
7,361,123 B1 * 4/2008 Krull ..... A63B 21/4029 108/116
7,591,763 B1 * 9/2009 Fucci ..... A63B 21/0552 482/121
2005/0148449 A1 * 7/2005 Weir ..... A63B 21/00047 482/142
2007/0087902 A1 * 4/2007 Penat ..... A63B 21/068 482/52
2015/0196799 A1 * 7/2015 Chua ..... A63B 23/1236 482/141

OTHER PUBLICATIONS

Website: https://revpart.conn/choosing-material-for-injection-molding/ archived: Apr. 20, 2016 retrieved: Feb. 4, 2019 (Year: 2016).*

* cited by examiner

*Primary Examiner* — Megan Anderson
(74) *Attorney, Agent, or Firm* — Muncy, Geissler, Olds & Lowe, P.C.

(57) ABSTRACT

A height-adjustable aerobic step is disclosed. The lower half of each supporting leg is disposed with a first positioning portion having two parallel first lateral plates and at least one first seizure portion on at least one first lateral plates, and the upper half of one extending leg is disposed with a second positioning portion which pivotally connects to the first positioning portion for the extending leg to be folded inwardly, or unfolded into a straight line with the supporting leg to elevate the height of rectangular step platform. The second positioning portion has two parallel second lateral plates which are respectively corresponding to and placed adjacent to the two first lateral plates, and sides of at least second lateral plates are disposed with at least one second seizure portion corresponding to the first seizure portion for fixing the position of the extending leg at different angles.

7 Claims, 4 Drawing Sheets

HEIGHT ADJUSTABLE AEROBIC STEP

FIELD OF THE INVENTION

The present invention relates to a height-adjustable aerobic step for allowing users to select different heights of the aerobic step so as to attain the effects for different exercise strengths.

BACKGROUND

The aerobic stepper (also referred to as an "aerobic step" or "step") commonly seen in the art are mainly comprised of a rectangular platform and two supporting legs respectively fixed below both ends in a length direction of the platform. The platform is upwardly supported by the two supporting legs and elevated by the height of the supporting legs, and is thus formed as a step platform for the user to step up and down with one foot from/to the front/back/left/right of the step during aerobic exercise, thereby allowing waist and leg exercise effects.

Conventional aerobic steps are manufactured by using the plastic injection molding process to form an integral structure. However, the volume of the aerobic step is huge and the structural design is complicated, which leads to high cost of mold development. Further, such aerobic steps utilize fixed-height platforms which cannot accommodate users of varying degrees of physical height and vary the intensity of the exercise to meet their individual needs.

SUMMARY OF THE INVENTION

In view of foregoing, after hard research and development, a height-adjustable aerobic step is provided by the present invention in order to solve the shortcomings described above.

The object of the present invention is to provide a height-adjustable aerobic step for users to selectively respectively fold two extending legs, or unfold the extending legs to position them to the bottoms of two supporting legs to effect different step platform heights, so as to respond to personal needs of different users for achieving adaptive fitness effects.

Another object of the present invention is to provide a height-adjustable aerobic step with a rectangular step platform structure combined by a first plate body, a second plate body and a connecting member, such that the volume of each component could be effectively reduced and the design could be simplified to efficiently reduce the production costs for developing molds.

In order to achieve the aforementioned objects, the height-adjustable aerobic step of the present invention comprises a rectangular step platform with two opposite ends in a length direction thereof and two supporting legs respectively downwardly extending from a bottom surface of each end, and is mainly characterized in that: a lower half of each supporting leg is disposed with a first positioning portion having two parallel first lateral plates with a side of at least one of them being disposed with at least one first seizure portion, and an upper half of one extending leg is disposed with a second positioning portion which pivotally connects to the first positioning portion for the extending leg to be folded inwardly relative to the supporting leg, such that a bottom surface of the supporting leg is at a top surface of the extending leg when the supporting leg and the extending leg are unfolded into a straight line. Further, the second positioning portion has two parallel second lateral plates which are respectively corresponding to and placed adjacent to the two first lateral plates, and a side of at least one of the second lateral plates is disposed with at least one second seizure portion for corresponding to the first seizure portion to limit its position.

In practice, the first positioning portion includes two parallel first lateral plates with a receiving space therebetween.

In practice, the second positioning portion includes a protrusion portion upwardly extending from the top surface of the extending leg, and the two parallel second lateral plates are respectively formed at two sides of the protrusion portion, and the protrusion portion is pivotally located into the receiving space of the two first lateral plates.

In practice, one of the correspondingly and adjacently placed first and second lateral plates is a bendable flexible plate.

In practice, the second seizure portion is at least one bump and the first seizure portion is at least one hole corresponding to the second seizure portion, and two first seizure portions are respectively provided on the first lateral plates at a substantially vertical angle. The first seizure portion also could be at least one bump and the second seizure portion could be at least one hole corresponding to the first seizure portion, and two second seizure portions are respectively provided on the second lateral plates at a substantially vertical angle.

In practice, the rectangular step platform includes a first plate body, a second plate body and a connecting member, and the two supporting legs respectively downwardly extending from one end of the first plate body and one end of the second plate body while the other end of the first plate body is horizontally opposed to the other end of the second plate body, and the connecting member respectively connects to the bottom surface of the first and second plate body.

In practice, the bottom surface of the first plate body is disposed with at least one first elongated recess and the bottom surface of the second plate body is disposed with at least one second elongated recess correspondingly communicating with the first elongated recess, and the connecting member includes at least one elongated rod which is correspondingly received in the mutually communicated first and second elongated recesses and respectively locked to the bottom surfaces of the first and second plate bodies.

Other objects, advantages and novel features of the present invention will become more apparent from the following detailed description when taken in conjunction with the accompanying drawings.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

The use of "a" or an is employed to describe elements and " " components described herein. This is done merely for convenience and to give a general sense of the scope of the invention. This description should be read to include one or at least one and the singular also includes the plural, or vice versa, unless it is clear that it is meant otherwise.

The height-adjustable aerobic step of the present invention comprises a rectangular step platform with two opposite ends in a length direction thereof and two supporting legs respectively disposed on a bottom surface of each end, and a lower half of each supporting leg is disposed with a first positioning portion, and the sides of at least one of first lateral plate of the first positioning portion is disposed with at least one first seizure portion. An upper half of one extending leg is disposed with a second positioning portion which pivotally connects to the first positioning portion, and two second lateral plates of the second positioning portion are respectively corresponding to and placed adjacent to the two first lateral plates, and the sides of at least one of the second lateral plates is disposed with at least one second seizure portion for corresponding to the first seizure portion to limit its position, thereby when the extending leg is folded inwardly or unfolded into a straight line with the supporting leg, the position of the extending leg could be fixed at different rotation angles.

Figure 1:
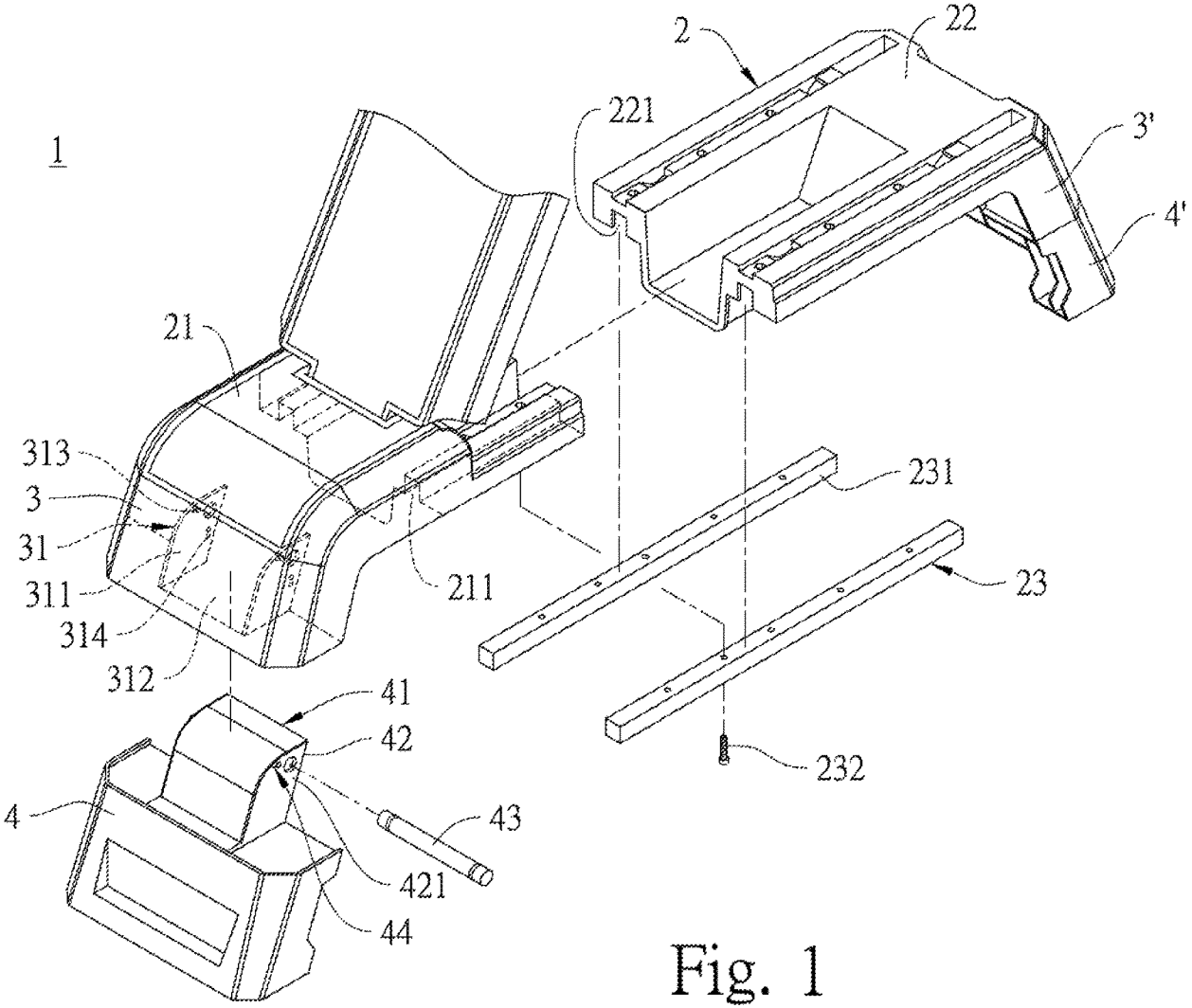
FIG. 1 is a partly exploded perspective view of the preferred embodiment of the present invention.
Figure 2:
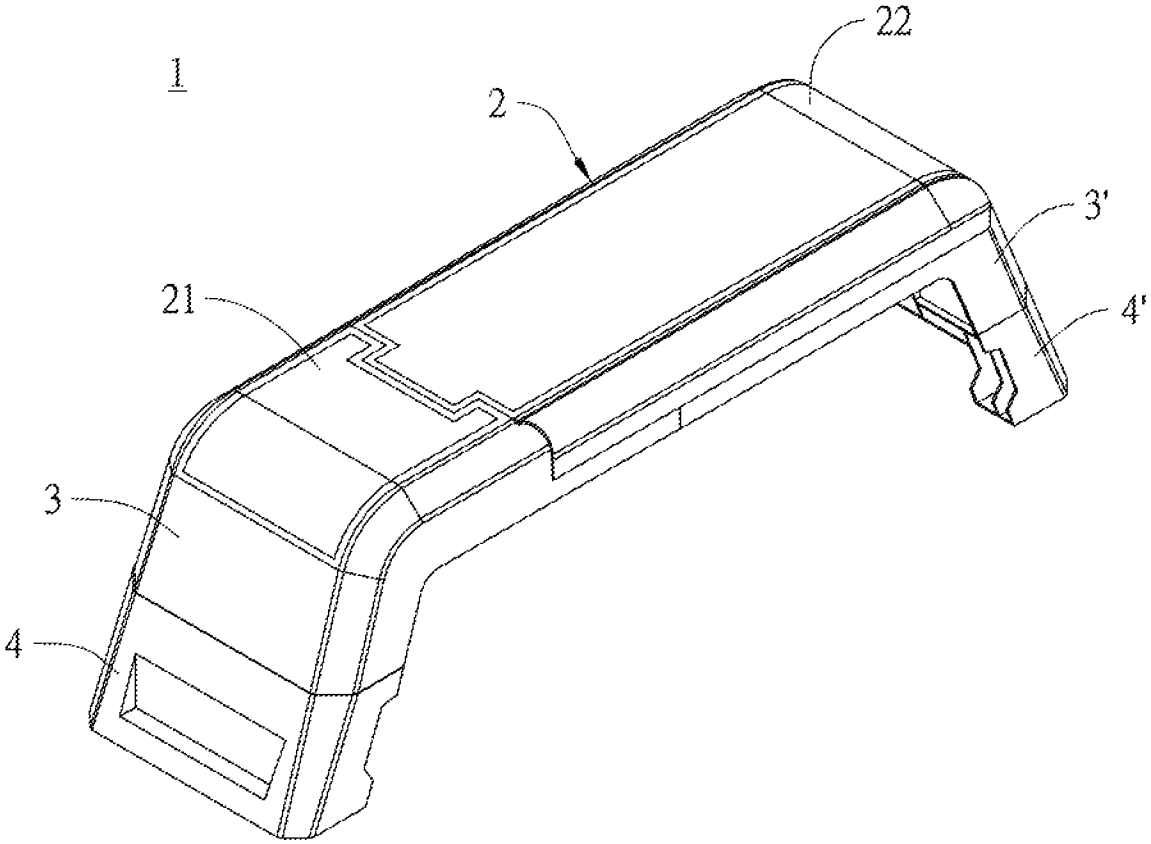
FIG. 2 is a perspective view of the preferred embodiment of the present invention.

Referring to FIGS. 1 and 2 which shows a preferred embodiment of a height-adjustable aerobic step 1 of the present invention, the height-adjustable aerobic step 1 comprises a rectangular step platform 2, two supporting legs (3, 3') and two extending legs (4, 4').

The rectangular step platform 2 includes a rectangular first plate body 21, a rectangular second plate body 22 and a connecting member 23, wherein one end in a length direction of the first plate body 21 is horizontally opposed to one end in a length direction of the second plate body 22, and the two supporting legs (3, 3') are respectively downwardly extending from bottom surfaces of the other end of the first plate body 21 and the second plate body 22. The bottom surface of the first plate body 21 is disposed with two first elongated recesses 211 parallel to the length direction of the first plate body 21, and the bottom surface of the second plate body 22 is disposed with two second elongated recesses 221 parallel to the length direction of the second plate body 22, and the two first elongated recesses 211 are respectively correspondingly communicating with the two second elongated recesses 221. Meanwhile, two elongated rods 231 are respectively received in two sets of the mutually communicated first and second elongated recesses (211, 221), and respectively upwardly locked to the bottom surfaces of the first and second plate bodies (21, 22) with a plurality of screw bolts 232, and these two elongated rods 231 are disposed to form the connecting member 23. In practice, there could be one or more sets of the mutually communicated first and second elongated recesses (211, 221) mentioned above, and a corresponding number of elongated rods 231.

The two extending legs (4, 4') respectively pivotally connect to the bottoms of the two supporting legs (3, 3'), and the two extending legs (4, 4') and the two supporting legs (3, 3') are formed by a plastic injection molding process. The following example is given to illustrate a combination of one supporting leg 3 and one extending leg 4, wherein the lower half of the supporting leg 3 is disposed with a first positioning portion 31 having two flexible first lateral plates 311 which are parallel and bendable, respectively. A receiving space 312 is formed between the two first lateral plates 311. The sides of any one of the first lateral plates 311 are disposed with two first seizure portions (313, 314) in the form of holes, and these two first seizure portions (313, 314) are disposed in any one of the first lateral plates 311 at a substantially vertical angle. The upper half of the extending leg 4 is disposed with a second positioning portion 41 with a projecting part 42 which is formed by upwardly extending from the top surface of the extending leg 4. Both sides of the projecting part 42 are respectively disposed with a bendable and flexible second lateral plate 421, and the two second lateral plates 421 are parallel to one another. As the projecting part 42 is pivotally located into the receiving space 312 of the two first lateral plates 311 by a pivot shaft 43, the two second lateral plates 421 are respectively corresponding to and placed adjacent to the two first lateral plates 311. In practice, any set of the combination of the correspondingly adjacently placed first lateral plates 311 and second lateral plates 421 may have only one lateral plate to be the bendable and flexible plate. Further, the side of any one of the second lateral plates 421 is disposed with a second seizure portion 44 in the form of two bumps, which are corresponding to the two holes of any one of the first seizure portions (313, 314) to limit its position.

Figure 3:
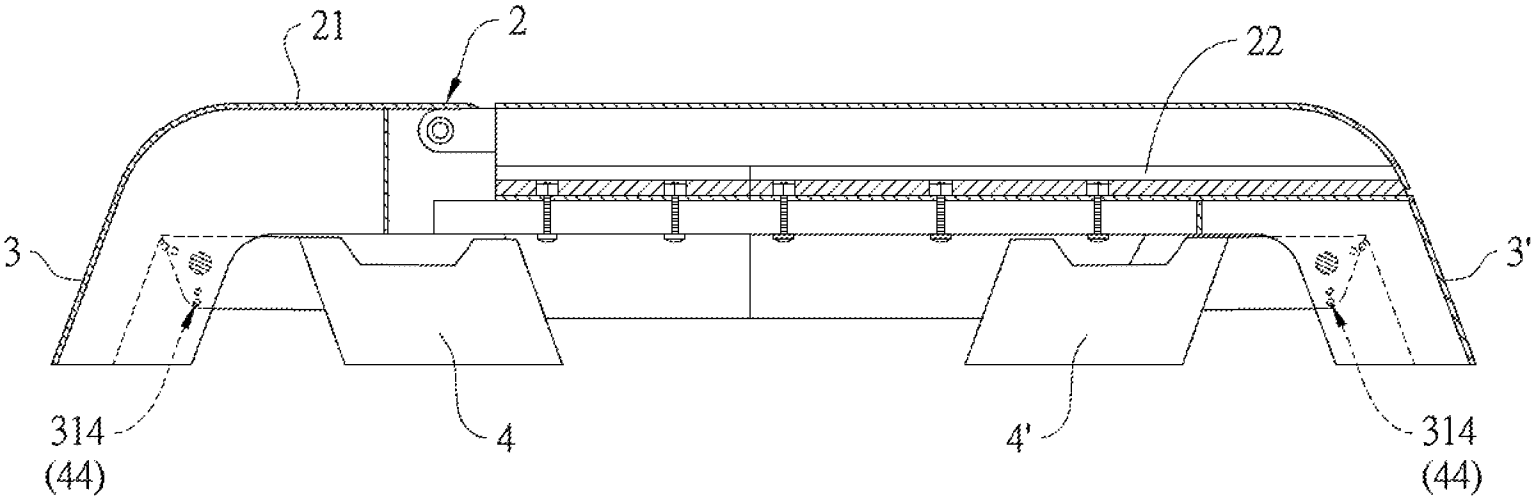
FIG. 3 is a schematic diagram showing two folded extending legs of the present invention in the usage condition.

As shown in FIG. 3, when the two extending legs (4, 4') are respectively swivelled to allow them to be inwardly folded relative to the two supporting legs (3, 3') respectively, the two extending legs (4, 4') could be laid on the bottom surfaces of the first and second plate bodies (21, 22) and positioned thereon by the corresponding engagement between the second seizure portion 44 of any one of the extending legs (4, 4') and a first seizure portion 314 of the supporting legs (3, 3'), such that the rectangular step platform 2 could have a fixed height configuration by the support formed by the two supporting legs (3, 3').

Figure 4:
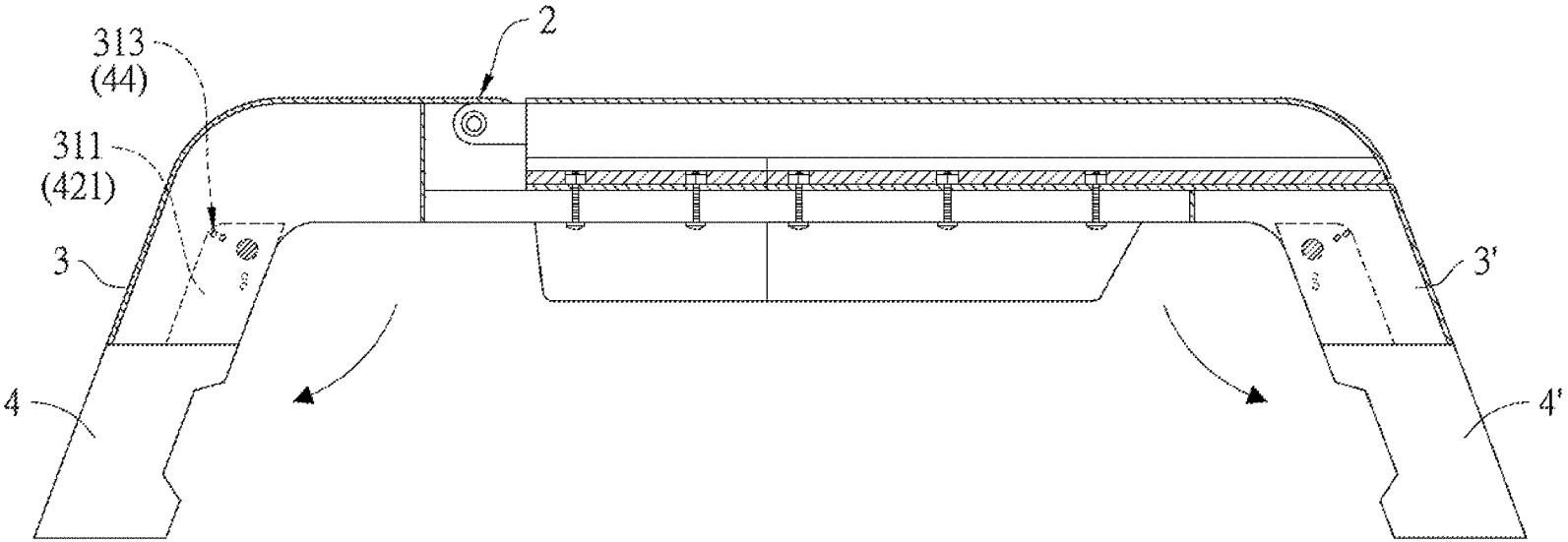
FIG. 4 is a schematic diagram showing two unfolded extending legs of the present invention in the usage condition.

As shown in FIG. 4, when the two extending legs (4, 4') are respectively swivelled outwardly by the user, since there is at least one lateral plate to be the bendable and flexible plate in any set of the combination of the correspondingly adjacently placed first lateral plates 311 and second lateral plates 421, the second seizure portion 44 of the second lateral plate 421 is allowed to move on the plate surface of the first later plate 311, such that the second seizure portion 44 of any one of the extending legs (4, 4') could correspondingly engage another first seizure portion 313 of the supporting legs (3, 3'), so as to make the two supporting legs (3, 3') and the extending legs (4, 4') be respectively unfolded into a straight line, thereby the bottom surfaces of the supporting legs (3, 3') is respectively at a top surface of the extending legs (4, 4') to allow the two extending legs (4, 4') to be steadily positioned for elevating the height of the rectangular step platform 2.

In practice, any one of the abovementioned first seizure portions (313, 314) could also be at least one bump, and the second seizure portion 44 is at least one hole corresponding to the first seizure portions (313, 314), and there are two second seizure portions 44 disposed in the second lateral plates 421 at a substantially vertical angle to allow any extending leg (4, 4') to be steadily positioned after swivel movement in the same way.

Therefore, the present invention has the following advantages:

1. The present invention utilizes different combinations of two supporting legs and two extending legs to allow the user to select exercise models of two different heights, so as to respond to personal needs of different users for achieving adaptive fitness effects.

2. The present invention utilizes the connecting members to connect the first and second plate bodies and combine into a rectangular step platform, such that the volume of each component could be effectively reduced and the design could be simplified to efficiently reduce the production costs for developing molds.

3. The lateral plate of any combination of the correspondingly and adjacently placed first and second lateral plates is a bendable flexible plate, such that after the seizure portion of one lateral plate abuts against and pushes out another lateral plate, the seizure portion could move on the plate surface of the another lateral plate in order to respectively engage and position to different seizure portion of the another lateral plate. Therefore, it could be conveniently used by a simple configuration.

As stated in the above disclosed, the present invention can surely achieve its expected objects to provide a height-adjustable aerobic step which allowing the user to select exercise models of different heights to attain the effects for different exercise strengths, and the manufacturing costs could be efficiently reduced to produce a simple and conveniently used configuration.

It is to be understood that the figures and descriptions of the present invention have been simplified to illustrate elements that are relevant for a clear understanding of the present invention, while eliminating, for the purposes of clarity, many other elements which may be found in the present invention. Those of ordinary skill in the pertinent art will recognize that other elements are desirable and/or required in order to implement the present invention. However, because such elements are well known in the art, and because such elements do not facilitate a better understanding of the present invention, a discussion of such elements is not provided herein.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A height-adjustable aerobic step comprising a rectangular step platform with two opposite ends in a length direction thereof and two supporting legs, each of the two supporting legs extending downwardly respectively from a bottom surface of each of the two opposite ends, wherein a lower half of each of the two supporting legs are disposed with a first positioning portion having two parallel first lateral plates with a side of each of the two parallel first lateral plates being disposed with two first seizure portions, an upper half of each of two extending legs is disposed with a second positioning portion pivotally connecting to the first positioning portion of each of the two supporting legs for each of the two extending legs configured to be folded inwardly relative to the two supporting legs such that a bottom surface of the two supporting legs are at a top surface of the two extending legs when the two supporting legs and the two extending legs are unfolded into a straight line, the second positioning portion has two parallel second lateral plates which are respectively corresponding to and placed adjacent to the two parallel first lateral plates, and a side of each of the two parallel second lateral plates is disposed with two second seizure portions for corresponding to the two first seizure portion and limiting a position of the two first seizure portion; and wherein the two parallel first lateral plates and the two parallel second lateral plates are bendable and flexible, so as to allow one of the second lateral plate to slide on a corresponding one of the first lateral plates.

2. The height-adjustable aerobic step according to claim 1, wherein the side of each of the first lateral plates is disposed with the two first seizure portions, the side of each of the second lateral plates is disposed with the two second seizure portions, the first second seizure portions of each of the first lateral plates are bumps, the two second seizure portions of each of the second lateral plates are holes corresponding to the bumps, and the two second seizure portions on each of the second lateral plates are provided at a vertical angle.

3. The height-adjustable aerobic step according to claim 1, wherein the rectangular step platform includes a first plate body, a second plate body and a connecting member, and the two supporting legs each extending downwardly from one end of the first plate body and one end of the second plate body while an other end of the first plate body is horizontally opposed to the other end of the second plate body, and the connecting member respectively connects to a bottom surface of the first and second plate body.

4. The height-adjustable aerobic step according to claim 3, wherein the bottom surface of the first plate body is disposed with at least one first elongated recess and the bottom surface of the second plate body is disposed with at least one second elongated recess correspondingly communicating with the at least one first elongated recess, and the connecting member includes at least one elongated rod which is correspondingly received in the at least one first and the at least one second elongated recesses and respectively locked to the bottom surfaces of the first and second plate bodies.

5. The height-adjustable aerobic step according to claim 1, wherein the two parallel first lateral plates are provided with a receiving space therebetween.

6. The height-adjustable aerobic step according to claim 5, wherein the second positioning portion includes a protrusion portion upwardly extending from the top surface of each of the two extending legs, and the two parallel second lateral plates are respectively formed at two sides of the protrusion portion, and the protrusion portion is pivotally located into the receiving space of the two parallel first lateral plates.

7. The height-adjustable aerobic step according to claim 1, wherein the side of each of the first lateral plates is disposed with the two first seizure portions, the side of each of the second lateral plates is disposed with the two second seizure portions, the two second seizure portions of each of the second lateral plates are bumps, the first seizure portions of each of the first lateral plates are holes corresponding to the bumps, and the two first seizure portions on each of the first lateral plates are provided at a vertical angle.

* * * * *